US005836181A

United States Patent [19]

Jonsson et al.

[11] Patent Number: 5,836,181

[45] Date of Patent: Nov. 17, 1998

[54] DIFFUSER

[75] Inventors: Lennart Jonsson; Björn Karlsson, both of Karlstad, Sweden

[73] Assignee: Kvaerner Pulping AB, Karlstad, Sweden

[21] Appl. No.: 649,845

[22] Filed: May 16, 1996

Related U.S. Application Data

[63] Continuation-in-part of Ser. No. 228,668, Apr. 18, 1994, abandoned.

[51] Int. Cl.[6] ..... D21D 5/02

[52] U.S. Cl. ..... 68/181 R; 162/60; 162/251; 210/333.01

[58] Field of Search ..... 68/181 R; 162/60, 162/251; 8/156; 210/333.01

[56] References Cited

U.S. PATENT DOCUMENTS

| | | | |
|---|---|---|---|
| 3,090,631 | 5/1963 | Hoover | 277/174 |
| 3,185,386 | 5/1965 | Gullichsen et al. | 68/181 R |
| 3,268,923 | 8/1966 | Burling | 8/156 |
| 3,348,390 | 10/1967 | Richter | 68/181 R |
| 3,599,449 | 8/1971 | Steiner | 74/89.15 |
| 3,887,196 | 6/1975 | Renfrow | 277/2 |
| 3,985,005 | 10/1976 | Leffler | 68/181 R |
| 4,172,037 | 10/1979 | Golston | 68/181 R X |
| 4,529,482 | 7/1985 | Richter et al. | 68/181 R X |
| 4,637,878 | 1/1987 | Richter et al. | 210/388 |
| 4,881,286 | 11/1989 | Richter et al. | 8/156 |

FOREIGN PATENT DOCUMENTS

| | | | |
|---|---|---|---|
| 340 216 | 11/1971 | Sweden | D21C 9/10 |
| 342 271 | 1/1992 | Sweden | D21C 9/10 |
| 583225 | 12/1977 | U.S.S.R. | D21C 9/00 |
| 589312 | 2/1978 | U.S.S.R. | D21B 1/02 |

*Primary Examiner*—Philip R. Coe
*Attorney, Agent, or Firm*—Seed and Berry LLP

[57] ABSTRACT

The invention relates to a diffuser having a substantially cylindrical container through which cellulose pulp is arranged to be transported, nozzle arms for delivering a fluid to the pulp, a scraper arm with scrapers spaced apart from the nozzle arms, and concentrically disposed screen surfaces and screen arms disposed on and connected to the screen surfaces for withdrawal of the fluid. The screen arms are provided, at their outer ends, with fixed, non-pivotal withdrawal pipes that are slidably controlled and are connected in sealing arrangement to filtrate outlets. The screen arms have interior withdrawal areas with increasing cross-sectional areas as the screen arms extend toward the withdrawal pipes. The screen arms also include long and short plugs for controlling the filtrate flow capacity of the diffuser. The invention relates also to a stuffing box designed to receive a rod, preferably a pull rod for raising and lowering a screen pack having screen surfaces in a diffuser, the rod being guided in sealing arrangement and slidably through a fixture which is mounted in a bearing for free movement in a plane substantially perpendicular to the rod. The bearing comprises a radially directed bearing flange extending around the fixture, which bearing flange is mounted between two radially directed retaining flanges extending around the fixture.

22 Claims, 7 Drawing Sheets

DIFFUSER

CROSS-REFERENCE TO RELATED APPLICATIONS

This application is a continuation-in-part application of U.S. Pat. No. 08/228,668 filed Apr. 18, 1994, now abandoned.

TECHNICAL FIELD

The present invention relates to a diffuser having a container through which cellulose pulp is arranged to be transported, nozzle arms for delivering a fluid, such as washing liquid, to the pulp, concentrically disposed screen surfaces and screen arms disposed on and connected to the screen surfaces for withdrawal of the fluid.

BACKGROUND OF THE INVENTION

A diffuser is shown and described in Swedish patent SE-B-342 271, which relates to a device for bleaching cellulose pulp. The withdrawal of the bleaching liquid is carried out through boxes which are disposed on the outer side of the container and into which there extend the screen arms provided, at their outer ends, with withdrawal pipes. Recesses in the wall of the container are covered by plates disposed on the boxes. This construction of the diffuser gives rise to heavy leakage from the container. Moreover, a raising and lowering device for a screen pack having screens mounted on screen arms is disposed on the bottom sides of each screen arm. The raising and lowering device includes a piston and cylinder assembly having a piston rod connected to the piston, and the piston rod is fixed to a pull rod that is fastened via a ball joint to the screen arm. The alignment of the screen pack is controlled in the upward and downward direction by a bushing around the withdrawal pipe or by a separate control system. There is herein a strong risk of the entire screen pack becoming tilted or skewed, resulting in the pull rod being bent with the stuffing box as the breaking point, such that the control bushing is exposed to bending forces. The damage which can arise if the screen pack should tilt increases the wear on the equipment, leading rapidly to operating breakdowns.

Swedish patent SE-B-340 216 has previously disclosed a cellulose-bleaching tower having an axially movable screen pack, in which devices in the form of hydraulic cylinders for raising and lowering the screen packs are disposed above the screen arms. In the case of this previously known bleaching tower, the piston rod of the hydraulic cylinder is guided through a bushing as a result of which leaking hydraulic liquid can trickle down in the bushing. Withdrawal of the fluid is further carried out by means of boxes disposed on the contacting surface of the container, as is also known from Swedish patent SE-B-342 271.

SUMMARY OF THE INVENTION

The above-stated drawbacks of the prior art are eliminated by a diffuser in accordance with the present invention. A diffuser in accordance with the present invention is the subject of Swedish Patent Application No. 9400215-1, entitled Diffuser, filed Jan. 24, 1994, from which priority has been claimed and which is incorporated herein by reference thereto. In a preferred embodiment, the diffuser includes a container through which cellulose pulp is transported, a nozzle arm having nozzles positioned in the container for delivering fluid to the pulp, a pulp outlet connected to the container for directing a portion of the pulp away from the container, and a scraper arm having a scraper movably positioned in the container to direct a portion of the pulp to the pulp outlet. The nozzle arm and scraper arm are spaced apart from each other with the scraper arm being above the nozzle arm to allow a seal-forming cap of pulp to form in the space between the nozzle and scraper arms. The nozzle and scraper arms are rotatable relative to the container, and the container has anti-rotation plates positioned below the scraper arm to resist the pulp from rotating within the container.

Screen arms are movably positioned in the container and connected to screen surfaces such that the screen arms and screens are movable vertically as a unit within the container. The screen surfaces are concentrically disposed about a central axis in the container, and the screen arms are coupled to the screens for withdrawal of the filtrate. A vertically directed withdrawal pipe is rigidly and non-pivotally attached to an outer end of the screen arms. The withdrawal pipe is telescopically extended into the filtrate opening and is sealably connected to the filtrate during vertical movement of the screen arms to substantially resist rotational movement of the screen arms relative to the container.

The screen arms extend radially outward from the center axis of the container and terminate at the withdrawal pipe. The screen arms have an interior withdrawal space that is coupled to the screens for channeling the filtrate from the screens, through the withdrawal space to the withdrawal pipes. The screen arms are constructed with the withdrawal space having a substantially continuously increasing cross-sectional area as the screen arm extends toward the withdrawal pipe.

In one embodiment of the invention, the screen arms have an upper member between the screen surfaces and the withdrawal area, and the upper member includes restriction holes therethrough for transmitting the filtrate from the screen surfaces to the withdrawal space. Plugs extend through the upper member and extend toward the restriction holes. The plugs include long plugs that extend into the restriction holes to reduce the flow of filtrate through the respective restriction hole, and short plugs that do not reduce the filtrate flow. Accordingly the flow rate of filtrate from the screens to the withdrawal space in the screen arms is controllable by selectively installing the long and short plugs in the upper member.

In a preferred embodiment, the diffuser includes a raising and lowering device connected to one of the screen arms for vertically moving the screens in the container. The raising and lowering device is positioned above the withdrawal pipe and substantially coaxially aligned with the withdrawal pipe. The container has an outwardly directed bulge with a bushing through which the withdrawal pipe is guided, and the raising and lowering device is positioned above the bulge and extends through an upper wall of the bulge.

BRIEF DESCRIPTION OF THE DRAWINGS

The invention is described in greater detail below with reference to appended drawings showing preferred embodiments, in which.

DETAILED DESCRIPTION OF THE INVENTION

Figure 1:
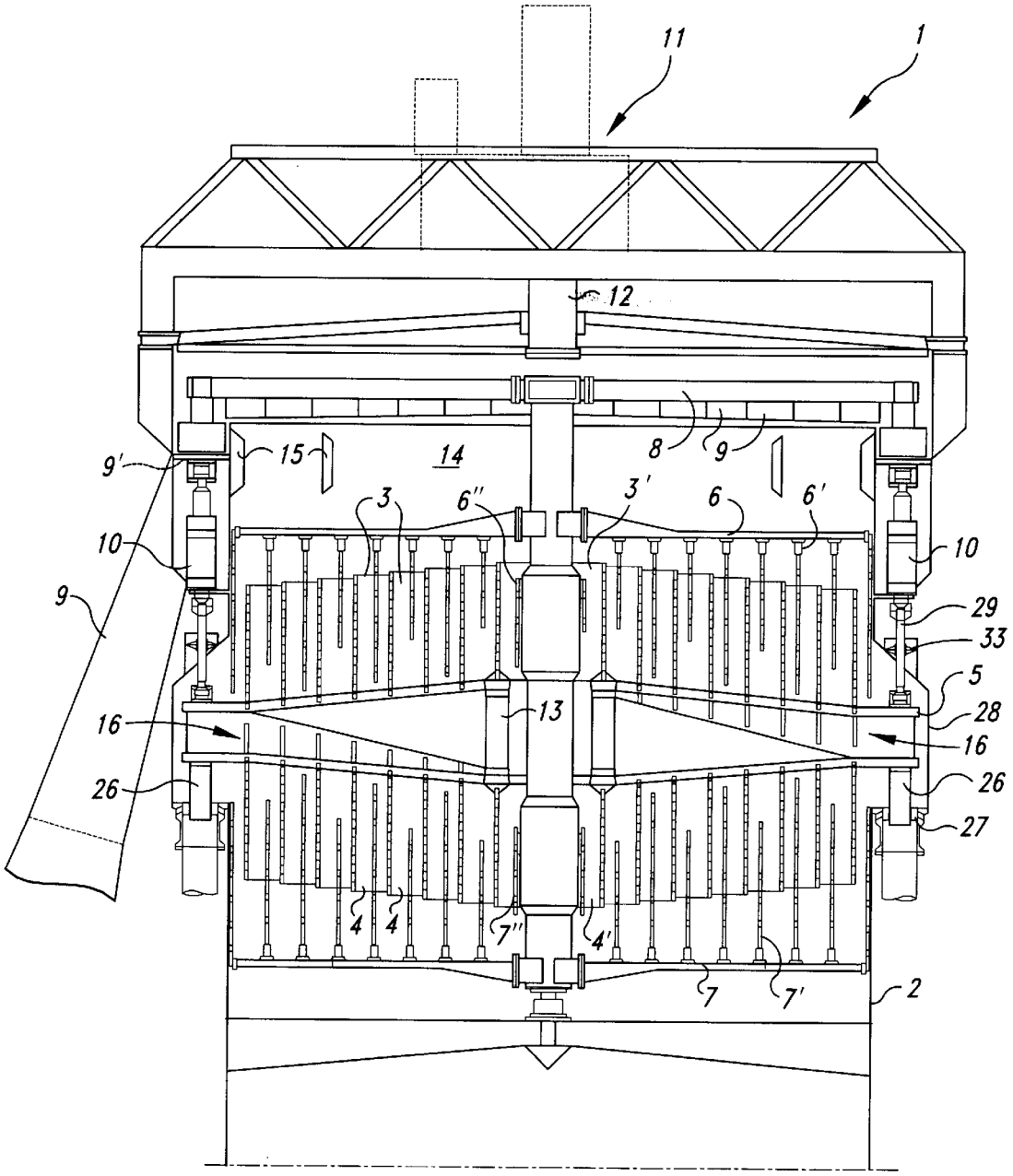
FIG. 1 is a cross-sectional view along a longitudinal axis of a diffuser according to the present invention.
Figure 2:
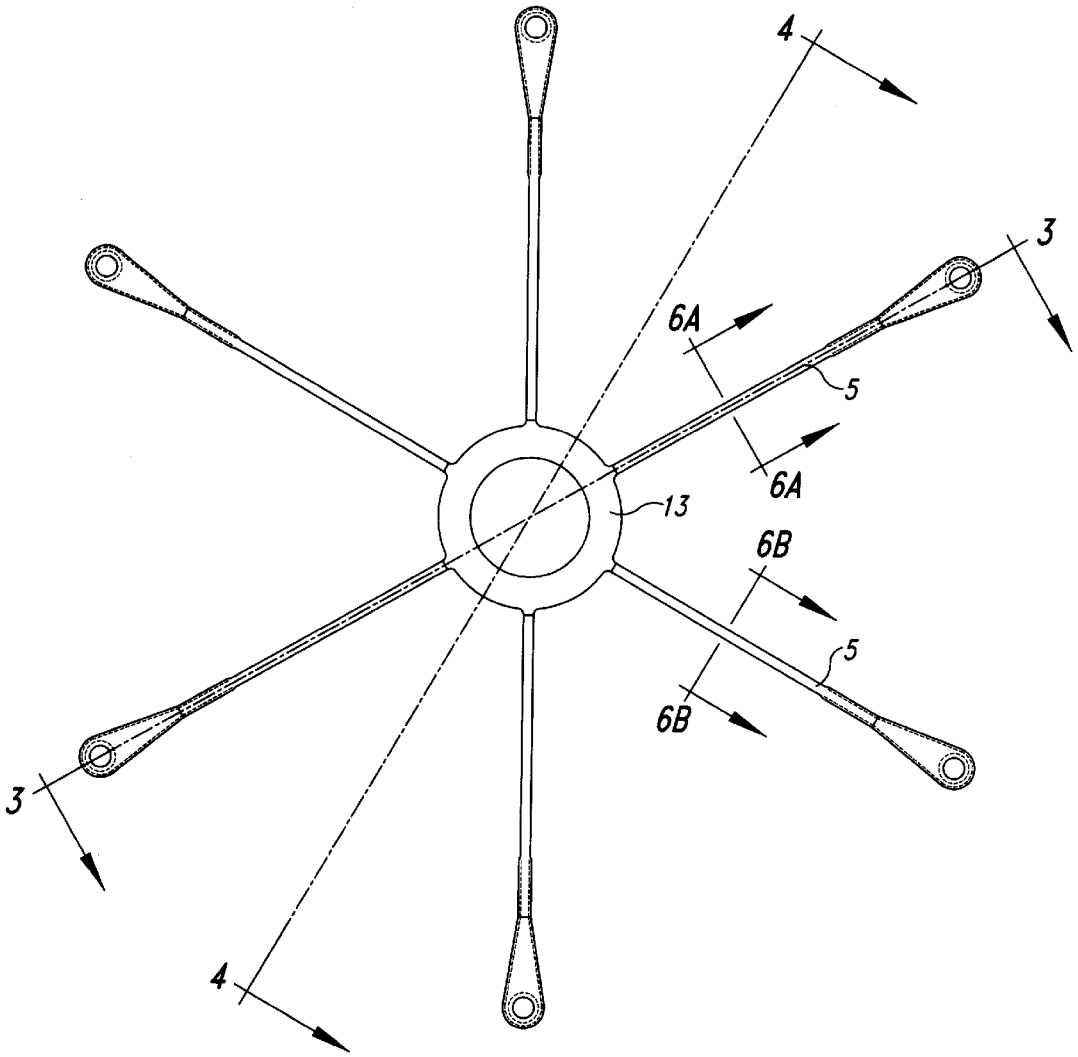
FIG. 2 shows a cross-sectional view through a screen assembly having screen arms of FIG. 1, in which connected screen rings and other parts of the diffuser according to the invention have been omitted for the sake of clarity.

A diffuser 1 according to a preferred embodiment of the present invention, shown in FIG. 1, includes a container 2, a screen pack having upper and lower screen rings 3 and 4 and screen arms 5, and upper and lower nozzle arms 6 and 7 having nozzles 6' and 7', respectively, for delivering fluid, such as washing liquid, to cellulose pulp in the container. The diffuser 1 also includes a scraping arm 8 of the ring-scraper type having scrapers 9, and a hydraulic piston and cylinder assemblies 10 distributed along the periphery of the container 2 for axial raising and lowering of the screen pack. A drive device 11, indicated by dashed lines, is mounted atop the container 2 for rotation of a center axle 12 and of the nozzle and scraper arms 6, 7 and 8 which are fixed on the center axle. One of the piston and cylinder assemblies 10 for axial raising and lowering of the screen pack is preferably disposed at the outer end of, and above, each screen arm 5. As best seen in FIGS. 1 and 2, the screen pack includes six screen arms 5 disposed on the diffuser 1 and the screen arms are in fluid connection with the screen rings 3, 4 (FIG. 1) in the screen pack. The screen arms 5 are radially directed from an annular hub 13. The number of screen arms 5 is not limited to the number shown in the preferred illustrative embodiment, but can be varied within the scope of the present invention. The same also applies, of course, to the number of screen rings 3, 4 and number of nozzles 6' and 7'.

Figure 9:
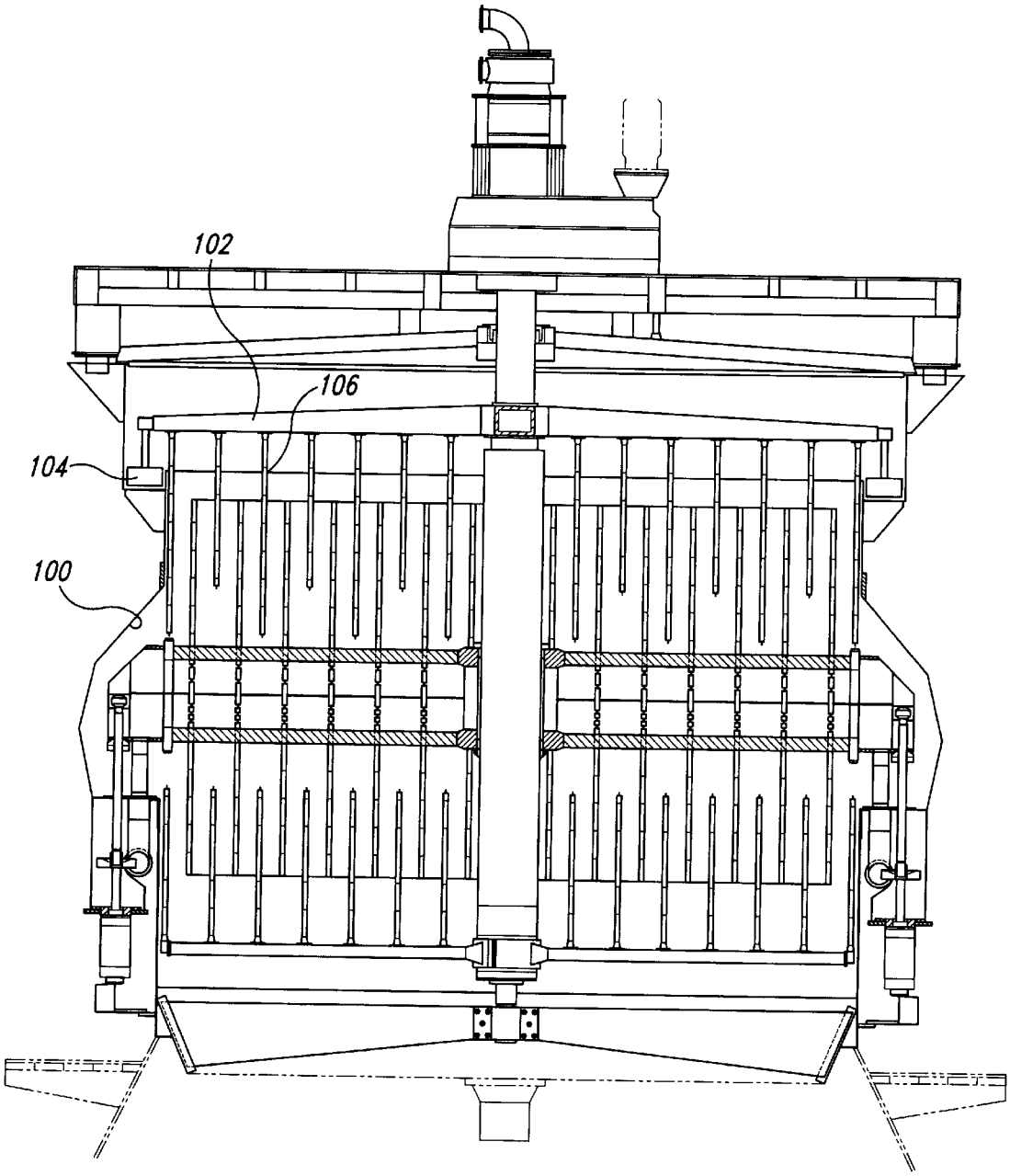
Fig. 9 (Prior Art)
FIG. 9 is a cross-sectional view of our prior diffuser design, which is prior art.

As best seen in FIG. 1, the scraping arm 8 having scrapers 9 is not provided with nozzles and has been designed merely to transport cellulose pulp radially outwardly to pulp outlets 9' of outlet chutes 9" connected to the container. This scraping arm construction enables the scraping device to be optimized for pulp transportation. The upper nozzles 6' are placed on the separate upper nozzle arm 6 below the scraping arm 8. Prior art diffusers such as is shown in FIG. 9, include a container 100 with a combined scraper and nozzle arm 102 having scrapers 104 and nozzles 106 connected to the same arm at the upper end of the container.

Between the nozzle and scraping arms 6 and 8 of the present invention there is formed a space 14. In this space 14, the inner wall of the container is provided with anti-rotation plates 15 to prevent the pulp from being brought into rotation by the rotating nozzle and scraping arms. During operation, a pulp layer is formed in the space to produce a reduced change in level during back-flushing and during a return stroke of the screen pack. The unbroken pulp layer also dampens the formation of gas at the screen rings. By virtue of the upper nozzle arm 6 and the scraping arm 8 being separated, the nozzles 6' are therefore unable to cut grooves in the pulp as occurs in the prior art diffuser of FIG. 9. This is particularly important in the case of high pulp concentration, where air is able to force its way down through the pulp and reach the screen pack. The pulp layer forms an effective cap that remains unbroken and prevents air from reaching the screen rings 3, 4 and the screen arms 5, which is very important when operating with a relatively high pulp concentration. As a result of separate nozzle and scraper arms 6 and 8, the upper and lower screen rings 3, 4 in the screen pack operate under equivalent conditions, which, in turn, produces more stable operation of the diffuser.

The lower nozzle arm 7 having the nozzles 7' is matched to the intended flow of fluid and at each end there is formed at least one opening. This means that the entire arm is flowed through by fluid and the risk of blockage at the outer opening is minimized. In addition, the nozzles 7' are shorter, which reduces the load on them.

Figure 3:
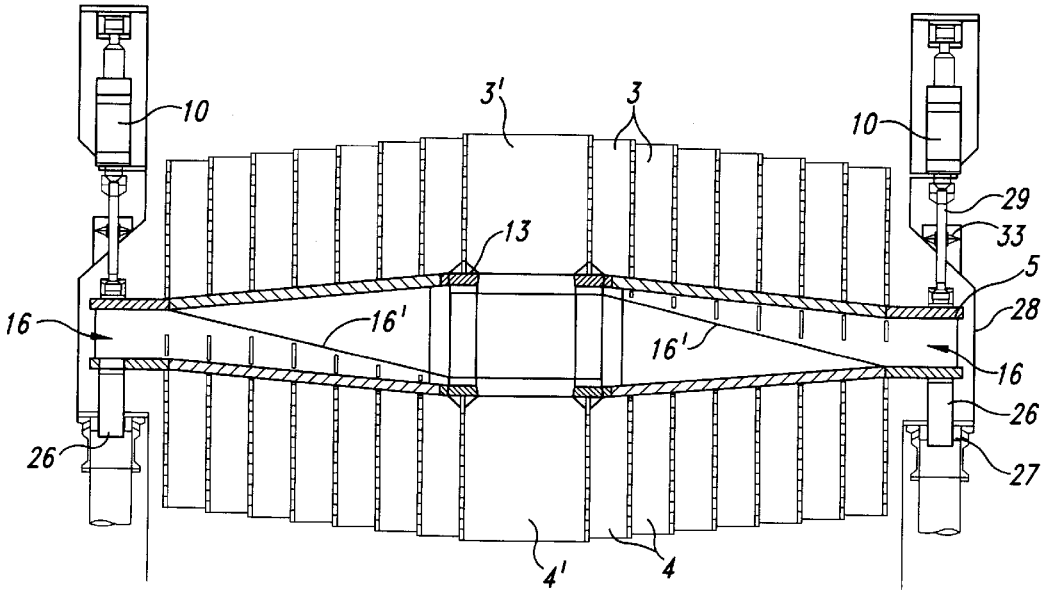
FIG. 3 is a cross-sectional view through a screen ring pack taken substantially along the line III—III in FIG. 2.
Figure 4:
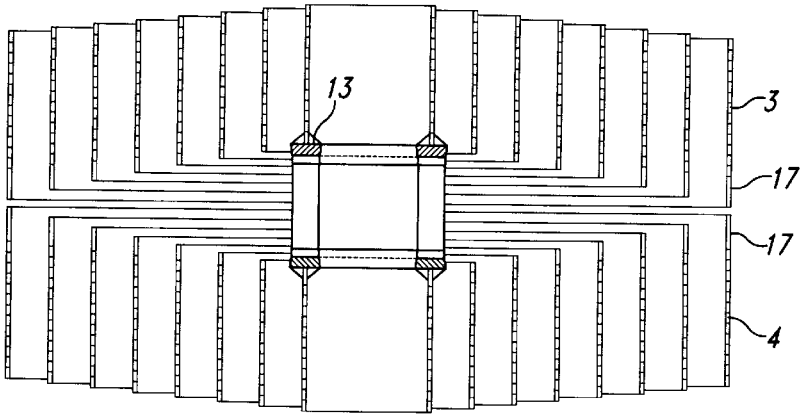
FIG. 4 is a cross-sectional view through the screen ring pack taken substantially along the line IV—IV in FIG. 2.

As best seen in FIGS. 1 and 3, the screen arms 5 of the screen pack have an inner withdrawal space 16 that receives filtrate from the screen rings 3, 4 and channels the filtrate radially outward. Each screen arm 5 is provided internally with guide plates 16', which demarcate the withdrawal space 16 for the fluid. The guide plates 16' are angled such that the withdrawal space 16 has an increasing cross-sectional area as the screen arm 5 extends outwardly from the annular hub 13. In the preferred embodiment, each of the screen arms 5 is a generally conical shaped arm with a larger cross-sectional area adjacent to the annular hub 13 and a smaller cross-sectional area at the arm's outer end. Three of the screen arms 5 form the filtrate withdrawal spaces 16 for the upper screen rings 3 and are configured as shown in the right portion of FIG. 3, and the three other screen arms are configured as shown in the left portion of FIG. 3 and form the withdrawal spaces for the lower screen rings 4. The screen arms 5 are distributed along the periphery of the diffuser in such a way that the withdrawal space 16 in every other screen arm is connected to the upper 3 and every other to the lower 4 screen rings. The diameters of the screen rings 3, 4 are matched to the diameters belonging to the screen rings in a screen pack having only upper screen rings.

In the screen pack, the screen arms 5 include a plurality of headers 17 that provide a collecting space for the filtrate along the edge of the upper and lower screen rings 3 and 4 which faces the withdrawal space 16. The headers 17 provide for efficient flow of the filtrate from the screen rings 3, 4 to the withdrawal spaces 16. The headers 17 also allow the screen rings 3, 4 to be quickly and easily mounted to the screen arms during assembly of the diffuser at a selected diffuser site. The headers 17 are positioned to define the location and spacing of the screen rings upon assembly of the screen pack. As a result, the screen packs can be transported as smaller units to the diffuser site and welded or otherwise assembled by local workers.

In the preferred embodiment the diameter of each screen ring 3 and 4 is equal for a diffuser having a screen pack having only upper or lower screen rings. The dimensions of the screen pack are adapted according to the particular flow. The withdrawal space 16 can be placed under or over the screen ring or, in the case of a double screen pack illustrated in FIGS. 1 and 3, between the screen rings. This construction of the screen pack results in the flow-paths being optimized, so that the liquid volume and gas volume in the screen pack are minimal. In the preferred embodiment, a double screen pack has been provided and the screen arms 5 disposed therebetween are provided with the internal withdrawal spaces 16 as discussed above.

Figure 6A:
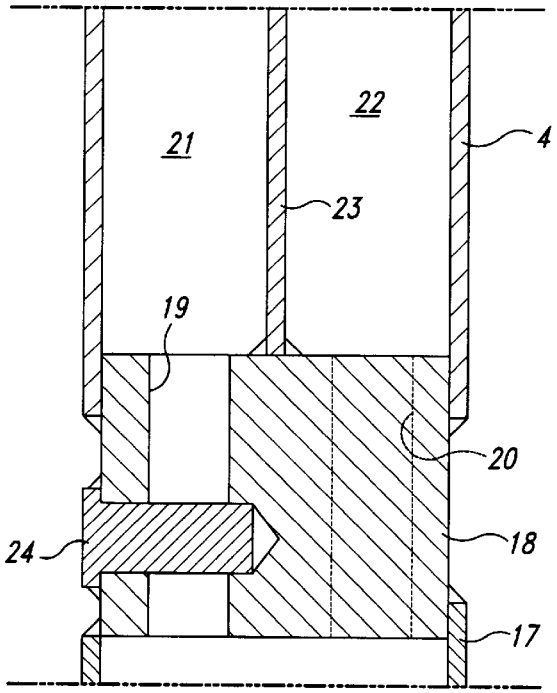
FIGS. 6A and 6B show a cross-section through a screen ring and illustrate a way to change the capacity in the diffuser according to the invention.
Figure 6B:
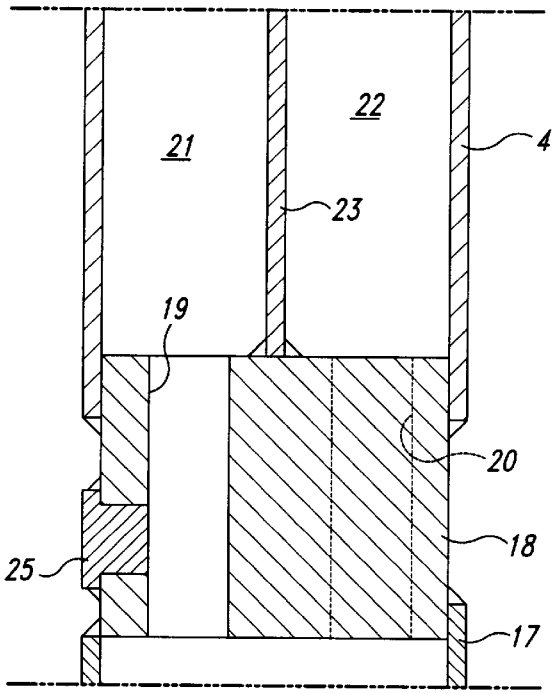

As best seen in FIGS. 6A and 6B the screen pack has restriction holes 19, 20 through which the filtrate flows as it enters the screen arms 5. The restriction holes 19, 20 are adapted to receive plugs 24, 25 that alter the capacity of the restriction holes of the screen pack. In the event production is below the diffuser's maximum capacity, selected restriction holes 19, 20 are plugged, as shown in FIG. 6A to reduce the filtrate flow. In the preferred embodiment, the screen arm 6 has a circumferential part 18 located between the screen ring 3, 4 and the header 17. The circumferential part 18 has the restriction holes 19, 20 formed between the screen ring and the header, and the holes, as can be seen from FIGS. 6A and 6B, connect to the inner spaces 21 and 22 of the screen ring, which are divided by means of a partition 23. Depending upon the desired capacity, the diffuser is configured with a predefined number of the restriction holes 19, 20, for example every other hole, plugged up by an elongated plug 24 according to FIG. 6A. The elongated plug 24 extends through an aperture in the circumferential part 18 transverse to the restriction hole 19 and across the restriction hole to substantially prevent filtrate from flowing through the restriction hole. The diffuser is thereby matched to a capacity from the start amounting to around half of its maximum capacity. As requirements increase, these elongated plugs 24 are exchanged with short plugs 25 that do not extend across the restriction holes 19, 20, whereupon the flow through the screen pack can be increased up to the diffuser's maximum capacity according to FIG. 6B.

As best seen in FIG. 1, the diffuser includes nozzles 6" and 7" which are disposed on the center axle 12 of the lower nozzle arm 7 at the center of the diffuser and are fed with fluid directly from the center axle 12 and not via the nozzle arms 6 and 7. The flow of liquid, such as the wash liquid, through these nozzles 6" and 7" can thus be made independent of the flow of liquid through the nozzle arms 6 and 7 and, preferably, a higher flow of liquid is produced than through other nozzles 6' and 7' to enable the pulp to pass easily through those screen rings 3' and 4' disposed nearest the center axle 12. This design minimizes the risk of the screen pack, i.e., the screen rings 3, 4 and the screen arms 5, and the center axle 12 arresting each others' movements when the pulp is fed forward therebetween.

The diffuser according to the invention, as shown in FIGS. 1–5, having eight upper and lower screen rings and having six screen arms, is dimensioned for a capacity in the order of magnitude of 2000 tons of cellulose pulp throughput every 24 hours. In a diffuser of this kind, the screen rings 3, 4 each have a height of between 1000 and 1500 mm, preferably 1100 mm in the case of a single diffuser and 1450 in the case of a double diffuser. The diffuser 1 according to the invention is preferably made from stainless steel containing at least 12% Cr and can also contain at least 10% Ni and/or at least 1% Mo.

In previously known diffusers as is shown in FIG. 9, the hydraulic piston and cylinder assemblies 10 for the movement of the screen pack are normally placed under the arm of the screen pack. This placement means that the cylinders are exposed to leakage from the above-situated stuffing box. By moving the piston and cylinder assemblies to the top side in accordance with the embodiment of the present invention illustrated in FIGS. 1, 3 and 5, they are placed in a sheltered position. The hydraulic drive assembly is expediently placed on an upper servicing level. By virtue of a divided casing at the center of the screen pack, an assembly unit is obtained, complete with hydraulics and drive. This unit can be fitted and tested prior to final assembly.

A withdrawal pipe 26 of the preferred embodiment is rigidly and non-pivotally connected to the outer end of each screen arm 5 and is directed substantially downwards. The withdrawal pipes 26 are guided telescopically through bearing bushings 27 disposed in recesses formed in the casing of the container 2, so that the withdrawal pipes open out into an outlet for filtrate. The rigid mounting of the withdrawal pipes 26 resist rotational forces that are transferred from the rotating nozzles by the pulp to the screen arms. The withdrawal pipes of the prior art diffuser illustrated in FIG. 9 is pivotally attached at the upper and lower ends, so they are unable to resist the rotational forces as is done by the embodiment of the present invention.

The outer ends of the screen arms 5 of the present invention extend into an annular bulge 28 in the wall of the container 2, and the withdrawal pipe within the bulge extends substantially vertically downwards through the bushing 27. It is also possible to configure a separate bulge 28 in the wall of the container 2 right in front of each screen arm rather than an annular bulge. The hydraulic piston and cylinder assemblies 10 are positioned above the annular bulge 28 which allows the bulges around the container to be smaller and have a smaller diameter. The smaller annular bulge 28 which contains at least a portion of the vertical withdrawal pipes 26 of the present invention is easier to construct during assembly, and it provides for improved access to components for maintenance and repair.

Figure 5:
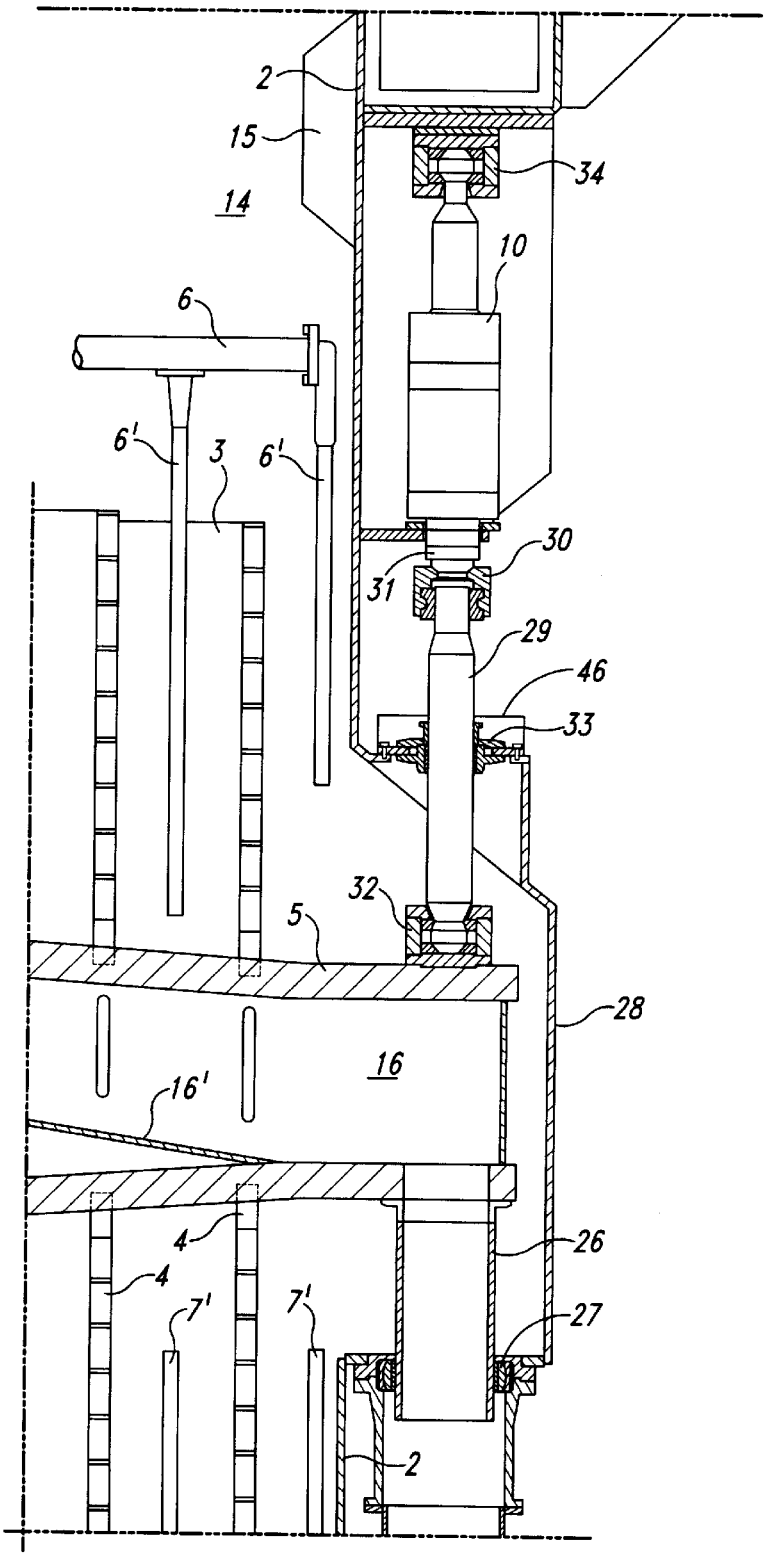
FIG. 5 shows a partial section of the diffuser according to the invention through the end of one of the screen arms.

As can be seen from the drawings, the withdrawal pipes 26 and the piston and cylinder assemblies 10 are disposed on either side of the outer ends of the screen arms 5. It is also possible, within the scope of the present invention, to direct the withdrawal pipes 26 upwards and mount them in control bushings arranged at the top of the annular bulge 28, in which case the piston and cylinder assemblies 10 are disposed under or over the screen arms. As a result of the pressure from the pulp located above the screen pack, a flow-pressure is generated upon the filtrate. The withdrawal pipes 26 can thereby readily be placed above the screen arms 5 and the longitudinal section of the withdrawal spaces does not have to be adapted for the running-off of filtrate, but rather the filtrate is forced automatically out of the withdrawal outlets of the diffuser at the bushings 27. It is most advantageous, on the other hand, for the withdrawal pipe 26 and piston and cylinder assembly 10 to be arranged as illustrated in FIGS. 1, 3 and 5, this by virtue of the fact that a stable raising and lowering of the screen pack can thereby occur, at the same time as the filtrate cannot significantly enter into contact with the bearing bushings through which the withdrawal pipes are guided. Moreover, leakage from the diffuser does not reach the hydraulic cylinder when this is mounted above the screen arm.

Pull rods 29, which are connected by means of a coupling 30 to the piston rod 31 in each piston and cylinder assembly 10, are flexibly connected at their lower end, by means of a ball joint 32, to the outer ends of each screen arm 5 within the bulge 28 in the wall of the container 2. Each pull rod 29 passes through the wall of the container via a seal-forming stuffing box 33, described in greater detail below, which is floatingly mounted, i.e., accompanies any movement of the rod 29 in the lateral direction whenever the screen pack is raised or lowered, and which is arranged in a pipe which is disposed on and is joined to the bulge 28. As a result of the arrangement of the floating stuffing box 33, no bending forces are transmitted to the cylinder or pull rod in the event the screen pack moves laterally. The piston and cylinder assemblies 10 are flexibly connected at their upper end, by a ball joint 34, to the outer side of the container. The control and vertical movement of the screen pack allows the screen pack to tilt as needed corresponding to the stroke length, without damage to machine parts.

Figure 7:
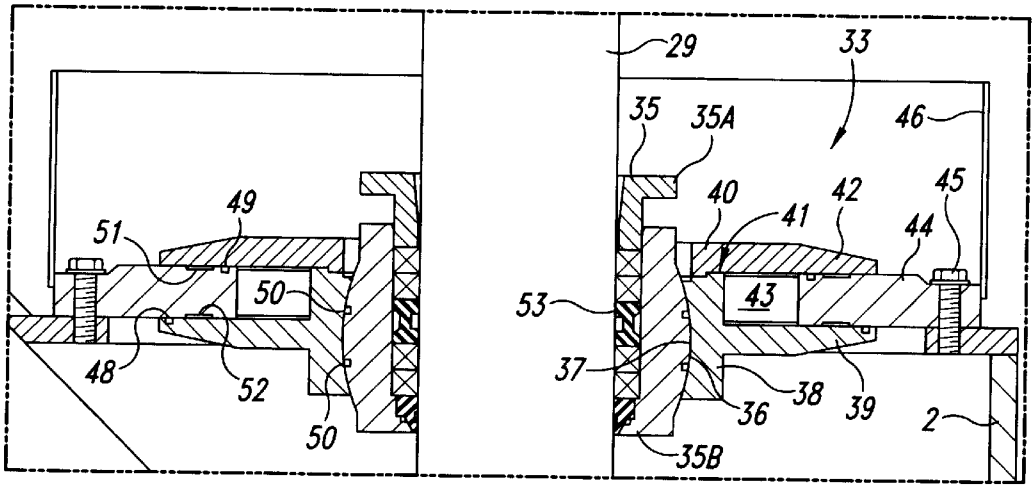
FIG. 7 shows a cross-section through a first embodiment of a stuffing box.
Figure 8:
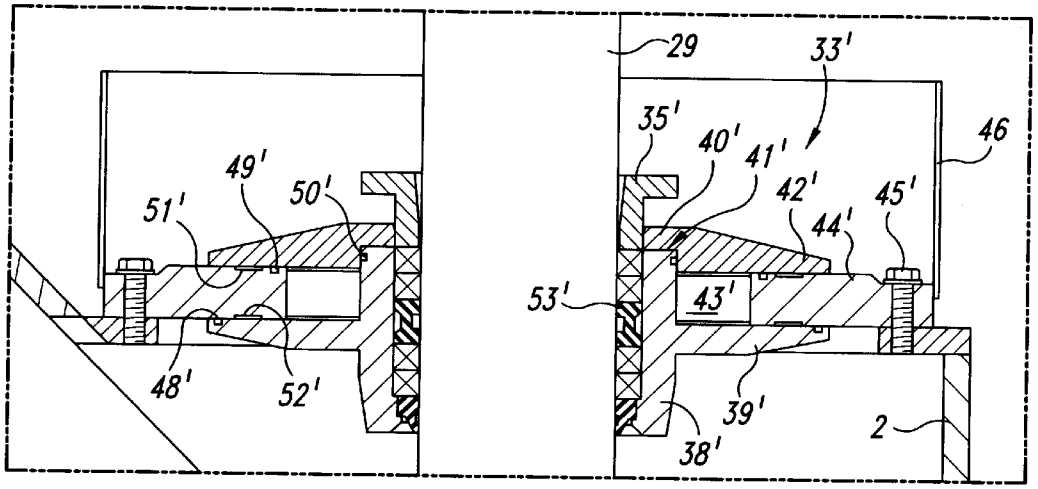
FIG. 8 shows a cross-section through a second embodiment of a stuffing box.

In FIGS. 7 and 8 there is shown, on a larger scale, two embodiments of the stuffing boxes 33 and 33', which are mounted such that the pull rod 29 can be displaced in the lateral direction if the pull rod is acted upon by radial forces.

In the case of the stuffing box 33 according to the embodiment in FIG. 7, the cylindrical fixture 35 of the stuffing box, which cylindrical fixture bears against the pull rod, is constituted by an inner part 35A which seals against the rod and an outer part 35B, having an outer spherical contacting surface 36, which is mounted in a spherical bearing shell 37 belonging to a lower, circumferential supporting part 38, this being provided with a circumferential, radially directed, lower flange 39. An upper, circumferential supporting part 40 is fixed to the lower supporting part 38 at 41 and comprises a circumferential, radially directed, upper flange 42. Between the lower and upper flanges 39 and 42, there is formed an annular space 43, in which there is inserted a circumferential, radially directed bearing flange 44. The circumferential flange is fixed at its outer circumferential edge, by means of a bolt connection 45, to the wall of the container 2.

A collecting box 46 for the collection of leak fluid is disposed right around the pull rod above the stuffing box 33 The stuffing box 33 can, of course, be mounted differently from the arrangement shown in the drawings, the main point being that it is able to move freely and in sealing arrangement in the radial direction, at the same time as the pull rod guided through the stuffing box is allowed to perform a rocking movement in all directions. A rotary movement of the rod extending through the stuffing box is also possible. The two parallel flanges 39 and 42 can thus be fixed to the wall of the container, or to a stationary frame, and the circumferential, radially directed bearing flange can constitute a part of or be fixed to a supporting part provided with an inner spherical bearing, which supporting part is mounted on the inner part.

As can be seen from the embodiment of the stuffing box 33' according to FIG. 8, the spherical bearing can be relinquished, in which case the fixture 35' is directly connected to upper and lower supporting parts 40' and 38', which are fixed to each other at 41' and bear flanges 42' and 39', respectively. The radially directed, circumferential bearing flange 44' is fixed by means of a bolt connection 45' to the wall 2 of the container and extends into the space 43' between the upper and lower flanges 42' and 39'. Here too, a collecting box 46' for leak fluid is disposed around the pull rod 29.

From the two embodiments of the stuffing box 33 and 33' according to FIGS. 7 and 8, it can be seen that circumferential grooves 48, 49 and 50 and 48', 49' and 50' are formed for seal-forming 0-rings. 51, 52 and 51', 52' denote upper and lower sliding elements. An annular seal 53 or 53' is disposed, for sealing of the rod, in the fixture 35 or 35', which bears and seals against the rod and is mounted such that it is slidably displaceable. The upper and lower supporting parts, as indicated above, are fixed to each other as shown in the drawings. It is possible, of course, within the scope of the appended patent claims, instead of two supporting parts, to have the stuffing box comprise just one supporting part.

The stuffing box shown in the drawings is not limited to use in a diffuser according to the invention, but can find other applications as a stuffing box designed for a rod, which stuffing box shall be able to perform a forward and reverse and/or rotary movement and which shall be able to absorb lateral forces acting against the rod. A predefined rocking movement in respect of the rod guided through the stuffing box can also be possible.

The diffuser according to the invention is not limited of course, to the embodiment described above and shown in the drawings, but can be modified within the scope of the appended patent claims.

We claim:

1. A diffuser, comprising:

a container through which cellulose pulp is arranged to be transported, the cellulose pulp including filtrate, the container having a filtrate outlet for directing the filtrate away from the container;

a pulp outlet connected to the container for directing a portion of the pulp away from the container;

a nozzle arm positioned in the container, the nozzle arm having nozzles for delivering a fluid to the cellulose pulp;

a scraper arm having a scraper movable relative to the container to direct the portion of the pulp to the pulp outlet;

a screen arm in the container and a plurality of screens disposed on and connected to the screen arm, the screen arm and the screens being movable vertically as a unit within the container, the screens being concentrically disposed about a central axis in the container, the screen arm being coupled to the screens for withdrawal of the filtrate, the screen arm having an outer end; and a vertically directed withdrawal pipe rigidly and non-pivotally attached to the outer end of the screen arm, the withdrawal pipe being slidably controlled relative to the container, the withdrawal pipe telescopically extending into the filtrate outlet and being a rigid structure connected in sealing arrangement to the filtrate outlet during vertical movement of the screen arm to substantially resist rotational forces exerted on the screen arm by the cellulose pulp relative to the container.

2. The diffuser of claim 1, further including a raising and lowering device connected to the screen arm for vertically moving the screens relative to the container, the raising and lowering device being above and aligned with the withdrawal pipe.

3. The diffuser of claim 2, wherein the container includes an outwardly directed bulge having a bushing through which the withdrawal pipe is guided.

4. The diffuser of claim 2 wherein the container has a wall and a stuffing box disposed in the wall, and the raising and lowering device includes a piston and a cylinder assembly connected to a pull rod, the pull rod being guided through the stuffing box and the stuffing box has a fixture for the pull rod, the fixture and the pull rod being movable together in a plane perpendicular to the pull rod to avoid binding during vertical movement of the screen arm and screens.

5. The diffuser of claim 1, further including a raising and lowering device connected to the screen arm for vertically moving the screens relative to the container, the raising and lowering device being generally coaxially aligned with the withdrawal pipe, the container has a wall and a stuffing box disposed in the wall, and the raising and lowering device includes a piston and a cylinder assembly connected to a pull rod, the pull rod being guided through the stuffing box and the stuffing box has a fixture for the pull rod, the fixture and the pull rod being movable together in a plane perpendicular to the pull rod to avoid binding during vertical movement of the screen arm and screens .

6. The diffuser of claim 1 wherein the nozzle arm and scraper arm are spaced apart from each other to define a space therebetween, and the scraper arm being above the nozzle arm to allow a seal-forming cap of pulp to form in the space between the scraper arm and the nozzle arm.

7. The diffuser of claim 6 wherein the container includes a plurality of anti-rotation plates positioned between the scraper arm and the nozzle arm to resist the pulp from rotating in the container.

8. The diffuser of claim 1 wherein the screen arm includes a plurality of headers thereon, and the screens are fixedly attached to the headers.

9. The diffuser of claim 1 wherein the screen arm includes an interior withdrawal space that receives the filtrate from the screens, the withdrawal space being coupled to the withdrawal pipe to direct the filtrate to the filtrate outlet, the withdrawal space having an increasing cross sectional area as the screen arm extends toward the withdrawal pipe.

10. The diffuser of claim 9 further including a center axle operatively connected to the nozzle arm, the screens being concentrically disposed about the center axle with a first screen adjacent to the center axle, the center axle having a nozzle for delivering the fluid to the cellulose pulp between the center axle and the first screen.

11. The diffuser of claim 1 wherein the screens have an interior area and the screen arm has an interior withdrawal space therein coupled to the interior area and to the filtrate opening for channeling the filtrate to the filtrate outlet, the screen arm having an upper member between the interior area and the withdrawal space, the upper member having restriction holes therethrough that extend between the interior area and the withdrawal space, the diffuser having first and second plugs that are connected to the upper member and that extend toward respective restriction holes to control a flow of the filtrate through the upper member to the withdrawal space, the first plug having a length that is greater than a length of the second plug, the first plug extending at least partially across a selected one of the restriction holes to at least partially block a flow of the filtrate therethrough.

12. The diffuser of claim 11 wherein the first plug fully extends across the selected restriction hole and substantially prevents the filtrate from passing through the selected restriction hole.

13. A diffuser, comprising:

a container through which cellulose pulp containing filtrate is arranged to be transported, the container having a central axis extending therethrough and having a filtrate outlet for directing the filtrate away from the container;

upper and lower nozzle arms positioned in the container and spaced apart from each other, the upper and lower nozzle arms having nozzles for delivering a fluid to the cellulose pulp, the upper nozzle arm being rotatable about the central axis relative to the container;

a pulp outlet connected to the container for directing a portion of the pulp away from the container;

a scraper arm having a scraper movably positioned relative to the container to direct the portion of the pulp to the pulp outlet, the scraper arm being rotatable about the central axis and being above the upper nozzle arm with a space therebetween, the scraper arm being out of engagement with the nozzle arm and spaced apart from the nozzle arm by a selected distance sized to allow a seal-forming cap of pulp to form in the space between the upper nozzle arm and the scraper arm;

a screen assembly movably positioned in the container below the upper nozzle arm, the screen assembly including a screen arm and a plurality of screens connected to the screen arm, the screen arm and the screens being movable vertically as a unit within the container between the upper and lower nozzle arms, the screens being concentrically disposed about the central axis in the container, the screen arm being coupled to the screens for withdrawal of the filtrate; and a withdrawal pipe attached to the screen arm and connected to the filtrate outlet.

14. The diffuser of claim 13, further including a raising and lowering device connected to the screen arm for vertically moving the screens relative to the container, the raising and lowering device being above and aligned with the withdrawal pipe.

15. The diffuser of claim 14 wherein the container has a wall and a stuffing box disposed in the wall, and the raising and lowering device includes a piston and a cylinder assembly connected to a pull rod, the pull rod being guided through the stuffing box and the stuffing box has a fixture for the pull rod, the fixture and the pull rod being movable together in a plane perpendicular to the pull rod to avoid binding during vertical movement of the screen arm and screens.

16. A diffuser, comprising:

a container through which cellulose pulp containing filtrate is arranged to be transported, the container having a filtrate outlet for directing the filtrate away from the container;

upper and lower nozzle arms positioned in the container and spaced apart from each other, the upper and lower nozzle arms having nozzles for delivering a fluid to the cellulose pulp;

a pulp outlet connected to the container for directing a portion of the pulp away from the container;

a scraper arm having a scraper movably positioned relative to the container to direct the portion of the pulp to the pulp outlet, the scraper arm being above the upper nozzle arm with a space therebetween, the scraper arm being out of engagement with the nozzle arm to allow a seal-forming cap of pulp to form in the space between the upper nozzle arm and the scraper arm;

a screen assembly movably positioned in the container, the screen assembly including a screen arm and a plurality of screens connected to the screen arm, the screen arm and the screens being movable vertically as a unit within the container, the screens being concentrically disposed about a central axis in the container, the screen arm being coupled to the screens for withdrawal of the filtrate;

a withdrawal pipe attached to the screen arm and connected to the filtrate outlet; and a raising and lowering device connected to the screen arm for vertically moving the screens relative to the container, the raising and lowering device being generally coaxially aligned with the withdrawal pipe, the container has a wall and a stuffing box disposed in the wall, and the raising and lowering device includes a piston and a cylinder assembly connected to a pull rod, the pull rod being guided through the stuffing box and the stuffing box has a fixture for the pull rod, the fixture and the pull rod being movable together in a plane perpendicular to the pull rod to avoid binding during vertical movement of the screen arm and screens.

17. A diffuser, comprising:

a container through which cellulose pulp containing filtrate is arranged to be transported, the container having a filtrate outlet for directing the filtrate away from the container;

upper and lower nozzle arms positioned in the container and spaced apart from each other, the upper and lower nozzle arms having nozzles for delivering a fluid to the cellulose pulp;

a pulp outlet connected to the container for directing a portion of the pulp away from the container;

a scraper arm having a scraper movably positioned relative to the container to direct the portion of the pulp to the pulp outlet, the scraper arm being above the upper nozzle arm with a space therebetween, the scraper arm being out of engagement with the nozzle arm to allow a seal-forming cap of pulp to form in the space between the upper nozzle arm and the scraper arm;

a screen assembly movably positioned in the container, the screen assembly including a screen arm and a plurality of screens connected to the screen arm, the screen arm and the screens being movable vertically as a unit within the container, the screens being concentrically disposed about a central axis in the container, the screen arm being coupled to the screens for withdrawal of the filtrate;

a withdrawal pipe attached to the screen arm and connected to the filtrate outlet; and a plurality of anti-rotation plates positioned in the container between the scraper arm and the upper nozzle arm to resist the pulp from rotating in the container.

18. A diffuser, comprising:

a container through which cellulose pulp containing filtrate is arranged to be transported, the container having filtrate outlets for directing the filtrate away from the container;

a vertically directed withdrawal pipe connected to the filtrate outlets;

a nozzle arm positioned in the container, the nozzle arm having nozzles for delivering a fluid to the cellulose pulp;

a screen assembly having a screen arm extending away from a central axis in the container and a plurality of screens connected to the screen arm, the screens being concentrically disposed about the central axis, the screen arm being coupled to the screens for withdrawal of the filtrate, the screen arm having an outer end connected to the withdrawal pipe, the screens having an interior area and the screen arm has an interior withdrawal space coupled to the interior area for channeling the filtrate to the withdrawal pipe, the screen arm having an upper member between the interior area and the withdrawal space, the upper member having restriction holes therethrough that extend between the interior area and the withdrawal space; and first and second plugs that are connected to the upper member to control the flow of filtrate through the restriction holes, each of the first and second plugs extending toward a respective one of the restriction holes, the first and second plugs having different lengths, the first plug being longer than the second plug, the first plug extending at least partially across a selected one of the restriction holes to at least partially block a flow of the filtrate therethrough.

19. The diffuser of claim 18, wherein the first plug fully extends across the selected restriction hole and substantially prevents the filtrate from passing to the withdrawal space.

20. The diffuser of claim 18 wherein the withdrawal space in the screen arm has an increasing cross sectional area as the screen arm extends toward the withdrawal pipe.

21. A diffuser, comprising:

a container through which cellulose pulp containing filtrate is arranged to be transported, the container having filtrate outlets for directing the filtrate away from the container;

a nozzle arm positioned in the container, the nozzle arm having nozzles for delivering a fluid to the cellulose pulp;

a screen assembly positioned in the container, the screen assembly having a plurality of screen arms with headers thereon and a plurality of screens attached to the headers and extending away from the screen arms, the screen arms and the screens being movable vertically as a unit within the container, the screens being concentrically disposed about a central axis in the container, the screen arms having interior withdrawal spaces coupled to the screens for withdrawal of the filtrate, the screen arms extending radially away from the central axis in the container, and the withdrawal spaces in the screen arms having an increasing cross-sectional area as the screen arms extend away from the central axis; and vertically directed withdrawal pipes attached to the screen arms, the withdrawal pipes being connected to the filtrate outlets during vertical movement of the screen arms and screens.

22. A diffuser, comprising:

a container through which cellulose pulp containing filtrate is arranged to be transported, the container having filtrate outlets for directing the filtrate away from the container, the container having a wall and a stuffing box disposed in the walls;

a nozzle arm positioned in the container, the nozzle arm having nozzles for delivering a fluid to the cellulose pulp;

a screen assembly positioned in the container, the screen assembly having a plurality of screen arms with headers thereon and a plurality of screens attached to the headers and extending away from the screen arms, the screen arms and the screens being movable vertically as a unit within the container, the screens being concentrically disposed about a central axis in the container, the screen arms having interior withdrawal spaces coupled through the screens for withdrawal of the filtrate;

vertically directed withdrawal pipes attached to the screen arms, the withdrawal pipes being connected to the filtrate outlets during vertical movement of the screen arms and screens; and raising and lowering devices connected to the screen arms for vertically moving the screens relative to the container, the raising and lower devices being above and aligned with the withdrawal pipes, at least one of the raising and lowering devices including a piston and a cylinder assembly connected to a pull rod, the pull rod being guided through the stuffing box and the stuffing box having a fixture for the pull rod, the fixture and the pull rod being mounted such that they together are movable in a plane perpendicular to the pull rod to avoid binding during vertical movement of the screen arms and screens.

* * * * *